US005673646A

United States Patent [19]

Knudson

[11] Patent Number: 5,673,646

[45] Date of Patent: Oct. 7, 1997

[54] STERN-MOUNTED MARINE CHEST

[76] Inventor: Robert L. Knudson, 9804 - 43rd Ave. NW., Gig Garbor, Wash. 98332

[21] Appl. No.: 568,951

[22] Filed: Dec. 7, 1995

[51] Int. Cl.[6] ..... B63B 17/00

[52] U.S. Cl. ..... 114/343; 224/328; 224/406

[58] Field of Search ..... 114/343, 364, 114/255, 362; 220/340, 334; 224/400, 401, 406, 328

[56] References Cited

U.S. PATENT DOCUMENTS

| | | | |
|---|---|---|---|
| 3,628,204 | 12/1971 | Hoffman, Jr. | 114/343 |
| 3,674,170 | 7/1972 | Thorpe et al. | 114/343 |
| 4,241,858 | 12/1980 | Lawroski | 224/401 |
| 4,406,387 | 9/1983 | Rasor | 220/334 |
| 4,671,439 | 6/1987 | Groeneweg | 224/401 |
| 4,728,017 | 3/1988 | Mullican | 224/328 |
| 4,827,864 | 5/1989 | LaMontagne | 114/343 |
| 4,907,673 | 3/1990 | Ginter et al. | 114/362 |
| 5,293,832 | 3/1994 | Potter, Jr. | 114/362 |

*Primary Examiner*—Sherman Basinger
*Attorney, Agent, or Firm*—David L. Tingey

[57] ABSTRACT

A removable storage locker sized to fit on a boat transom step platform provides storage and counter space to the boat. The locker includes a hinged upper lid which in its closed position provides a slightly-sloped counter surface for water drain-off at a level commensurate with that of the transom. Hinges are located astern of the transom on a locker rim protruding along the locker hinge side such that the lid opens away from the boat. The hinges are covered by an overhanging, downward-extending, rearward lid skirt to protect the hinge, allowing the lid to open at least 90 degrees with the rearward skirt extending under the rearward rim. The hinge movement is limited by the lid skirt contacting the rim underside, allowing the lid to lean astern until contact is made, the lid thus being stably supported in its open position.

9 Claims, 5 Drawing Sheets

STERN-MOUNTED MARINE CHEST

The present invention relates generally to boating accessories, and more particularly to removable storage lockers for marine use adapted for mounting on a boat rearward of its transom.

It is known in the art to have various storage lockers for boats. Often the lockers fit in various recesses, walkways, or seating areas of the boat. It is not known to have a storage especially adapted to mount rearward of a boat's transom.

It is now common to have power boats with a step platform rearward of its transom. Because the platform is astern of the area in which persons and their gear are normally found, use of the transom platform provides additional storage rather than subtracting from otherwise used boat areas. The top of a storage locker on the transom platform can also serve as additional counter area.

Provision of the storage locker outward of the transom presents problems or compounds problems of marine lockers: generally, water is more likely to splash onto or into the locker. Accordingly, it is the object of the present invention to provide a storage locker sized to be secured on a transom platform that compensates for effects of splashing water and generally adapts to access from within the boat and adds available counter area.

SUMMARY OF THE INVENTION

The storage locker of the present invention discloses a removable storage locker sized to fit on a platform rearward of the transom of a boat, providing additional storage and counter space to the boat. The locker includes a hinged upper lid which in its closed position provides a counter surface, slightly sloped to assist water drain-off. In the preferred embodiment, the lid is at a level commensurate with that of the transom or any approximately horizontal surface integral with the transom. Hinges are located astern of the transom on a locker rim protruding along the locker hinge side such that the lid opens away from the boat. The hinges are covered by an overhanging, downward-extending, rearward lid skirt. With the hinges thus mounted rearward of the locker hinge side, the cover skirt protects the hinge and allows the lid to open at least 90 degrees with the rearward skirt extending under the rearward rim. The hinge movement is limited by the lid skirt contacting the rim underside, allowing the lid to lean astern until contact is made, the lid thus being stably supported in its open position.

The invention also includes a marine craft incorporating the locker as set forth above.

DETAILED DESCRIPTION OF THE PREFERRED EMBODIMENT

Figure 1:
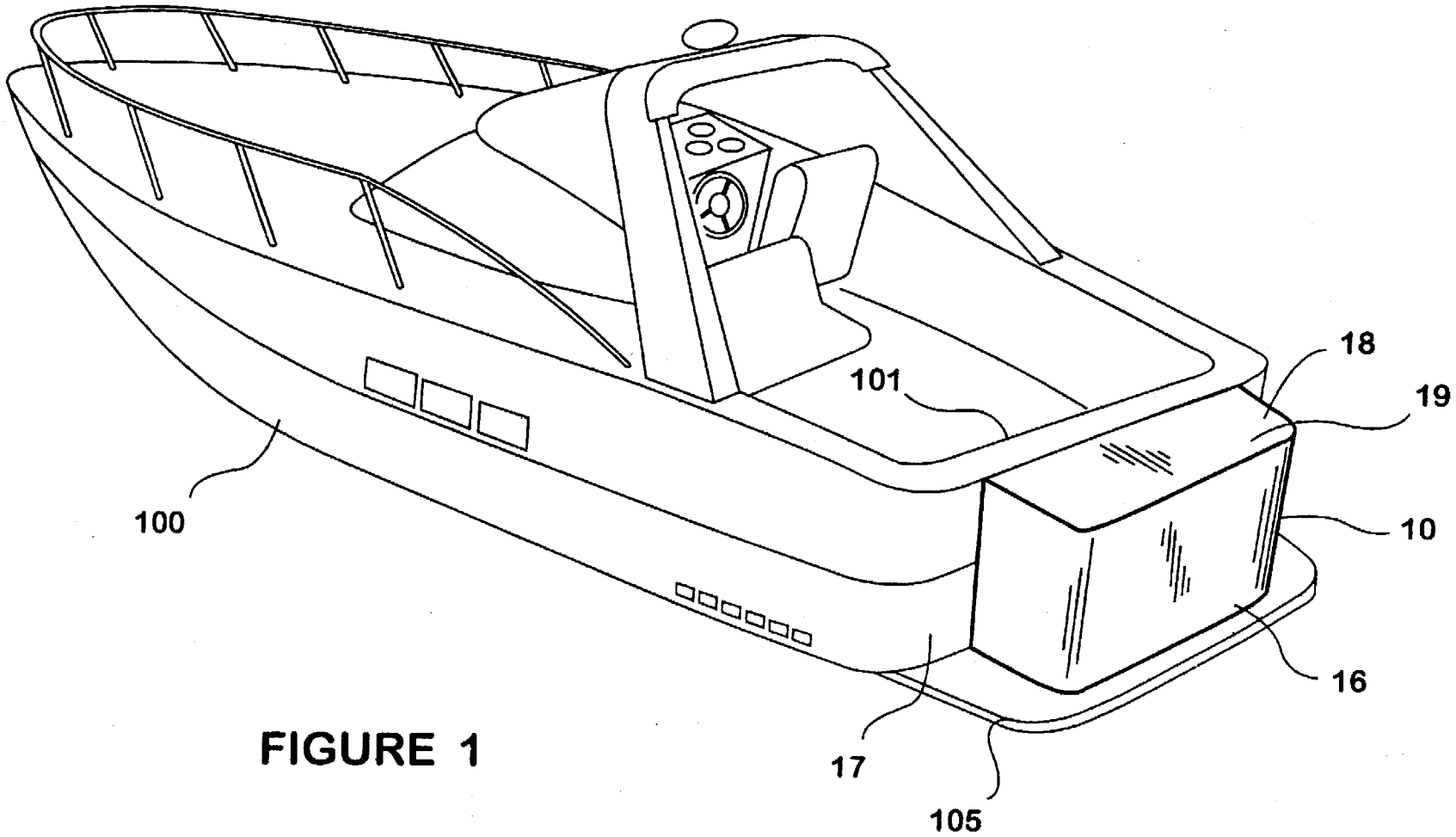
FIG. 1 is a perspective view of a boat incorporating a marine storage locker astern of its transom.
Figure 2:
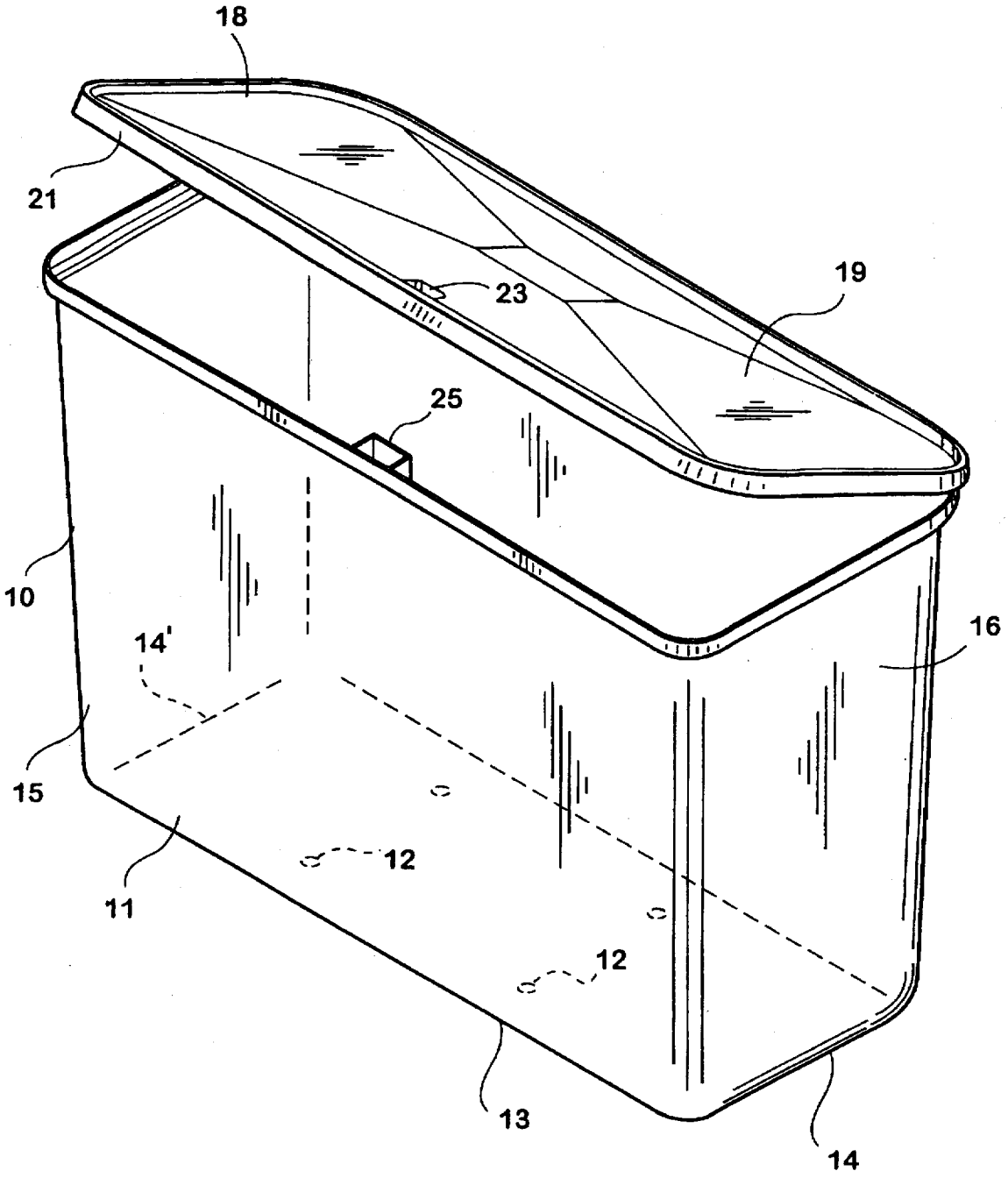
FIG. 2 is a perspective view of the marine locker.
Figure 3:
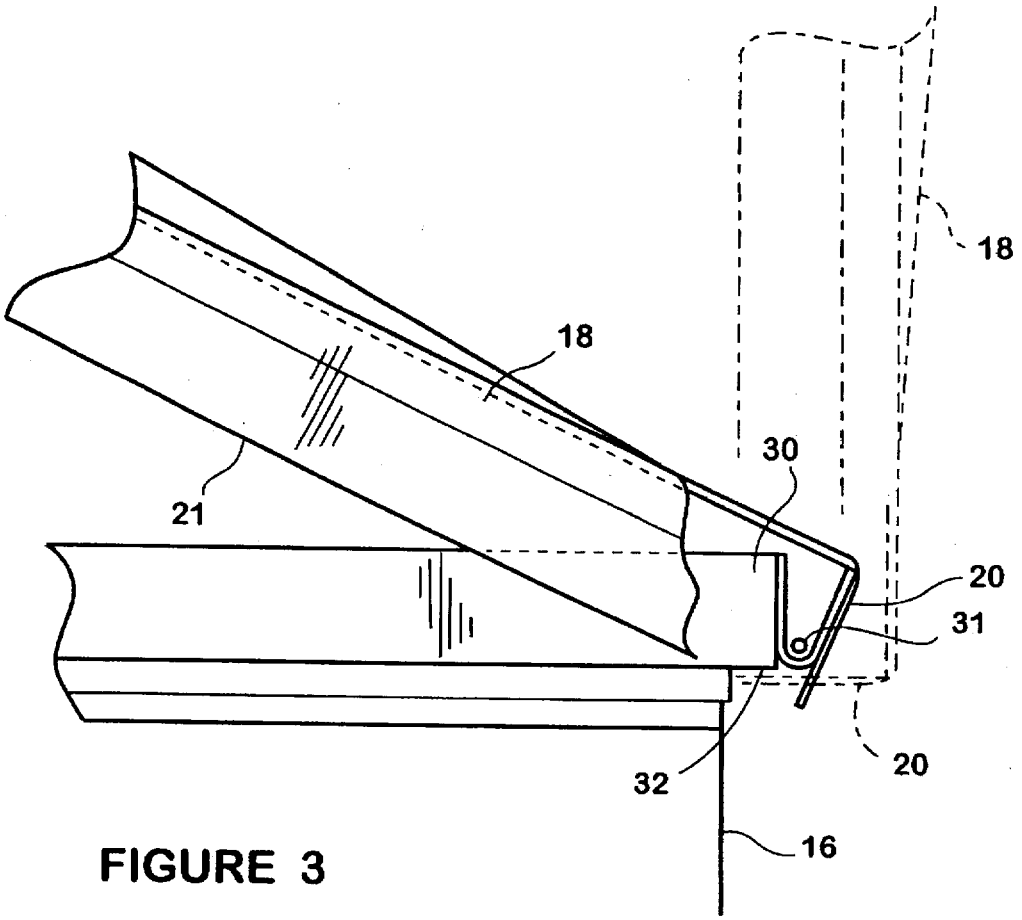
FIG. 3 is a side view of the locker hinge.
Figure 4:
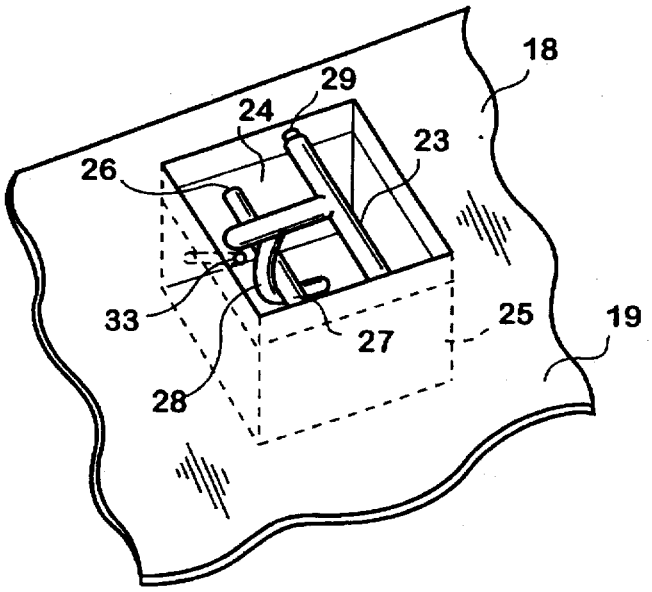
FIG. 4 is a perspective view of the latch.
Figure 5:
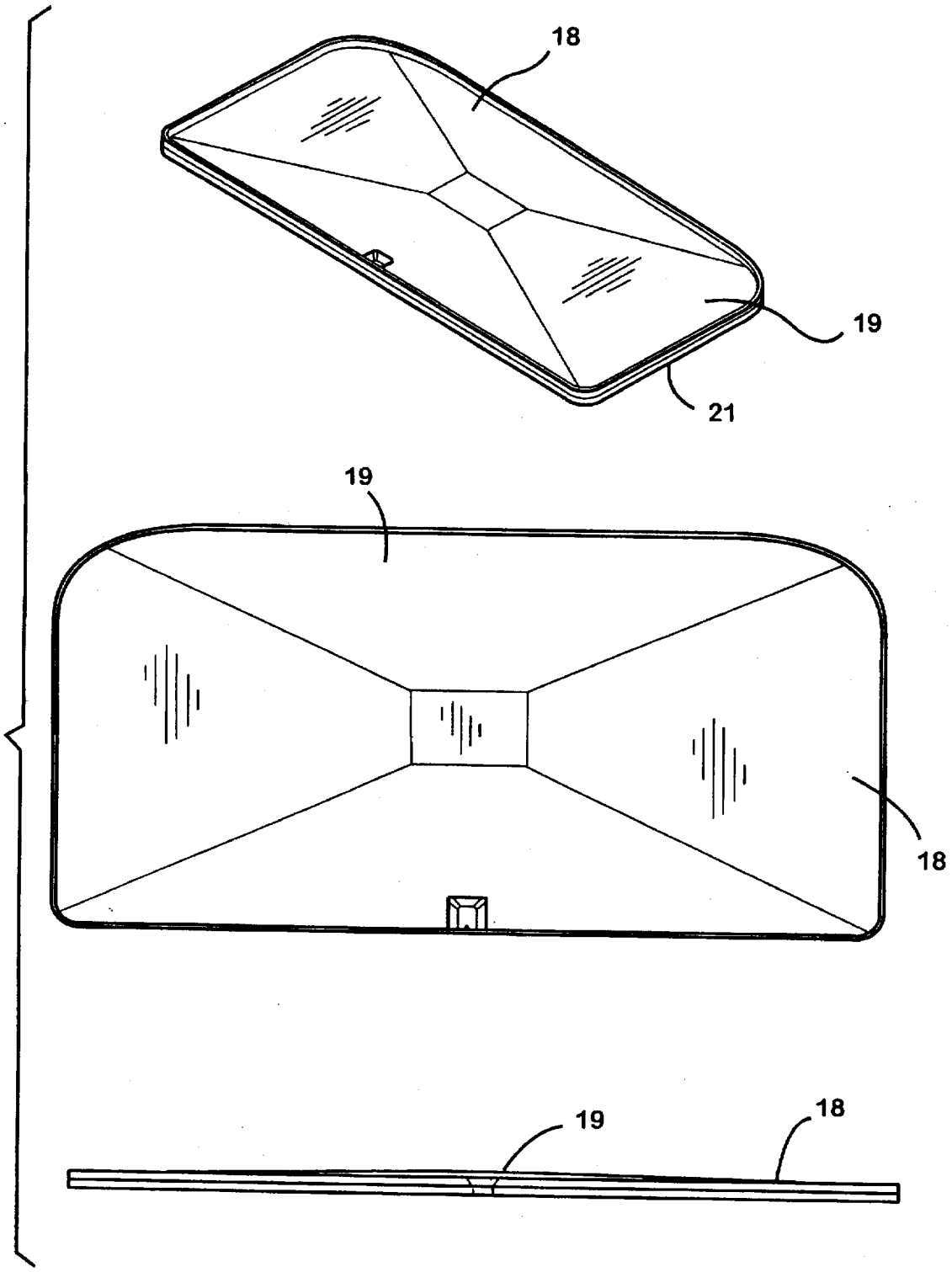
FIG. 5 is a perspective view of the locker lid with open lid.
Figure 6:
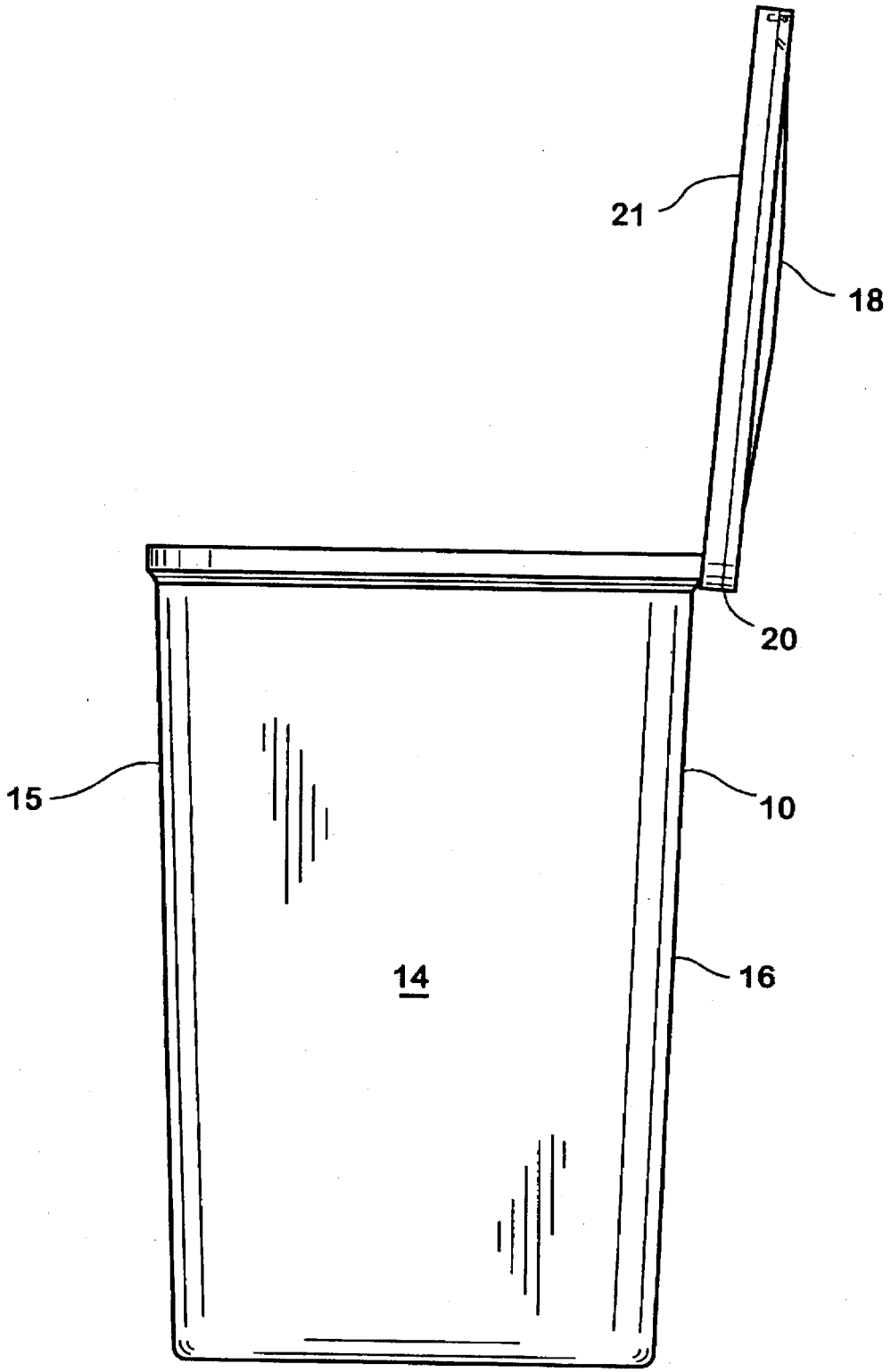
FIG. 6 is a side view of the locker lid.

Referring to the figures, a marine storage locker 10 of the present invention comprises a box-like container shaped and dimensioned to closely fit removably on a boat step platform 105 of a boat astern of its transom 16 and a boat 100 having such a step platform 105 incorporating said locker 10.

The locker 10 comprises a bottom 11 with drain holes 12. Joined about the bottom perimeter 13 are first and second opposing sides 14, 14' separated by a front side 15 for disposition face to face with the boat transom 17 and a back side 16 opposite the front side 15. The locker 10 is sized such that the locker lid 18 is at a level commensurate with that of the transom 17 when installed on the step platform 105. Commonly, a boat 100 with a step platform 105 includes a transom 17 with a horizontal surface 101 integral therewith for use as a counter, in which case the locker 10 is sized such that the locker lid 18 is at a level commensurate with that of the transom horizontal surface 101 to serve as an extension of the counter.

A locker lid 18 is mounted to the locker back side 16 at its top. The lid 18 includes an approximately flat top 19 slightly sloped to encourage water to drain off. The lid 18 further includes an overhanging, downward-extending skirt 20 at the locker back side 16. The lid 18 may also provide front and first and second side skirts 21 completing a lid skirt around its perimeter.

A locker back rim 30 protrudes from the locker back side 16 at its top and including a vertical face 33 over which the back lid skirt 20 extends. A hinge 31 is attached rearward of the locker back side between the locker back rim vertical face 33 and the lid skirt 20 at the locker back side 16 such that the skirt 20 covers the hinge 31, protecting the hinge 31 from the elements. The lid 18 opens on the hinge 31 away from the boat 100 at least 90 degrees with the rearward lid skirt 20 extending under the locker back rim 30, the skirt 20 having downward dimension less than the rim 30 protrudes from the locker back side 16. As the lid 18 opens astern with the skirt 20 rotating under the rim 31, the lid rotational movement is limited by the lid skirt 20 eventually contacting the rim underside 32. The lid 18 thus rotates on the hinge 31 slightly more than 90 degrees so that gravity biases the lid 18 in an open position with the lid 18 stably leaning against the rim 21.

The locker lid 18 further comprises a water-resistant lid latch 23 in the lid top 19 at the front side 15, near the transom 17 as the locker 10 is placed in close fit on the step platform 105 against the transom 17, the locker front side 15 being too close to the transom 17 to accommodate a latch. A lid recess 24 is included in the lid 18 in which the lid latch 23 is mounted below the lid top 24 to maintain a generally flat, unobstructed counter-like top.

A small latch box 25 is included within the locker 10 on its front side 15 under the lid latch 23 within which is included a locker latch 26 operating in cooperation with the lid latch 23. The locker latch 26 may comprise a bar 27, and the lid latch 23 may comprise a hook 28 rotating on a pivot pin 29 within the lid recess 24. To discharge water that might enter the small latch box 25 through the lid recess 24, the small latch box 25 is isolated from the box internal volume proper and drained external to the box through a water channel hole 33 in the locker front side 15.

One skilled in the art will recognize the advantages taught by this invention and illustrated by the preferred embodiment presented. The specification and drawings are not intended to represent an exhaustive description of the invention. Obvious applications and extensions of the invention are intended to be within the spirit and scope of this invention.

Having described the invention, what is claimed is:

1. A marine storage locker for use on a boat having a step platform astern of a boat transom, the transom terminating in a transom top, the step platform comprising a vertical portion of the boat transom and a horizontal bottom, the improvement in said marine storage locker comprising a box-like container including first and second opposing locker sides separated by a front side and a back side opposite the front side, the sides terminating at upper and lower ends and joined about a bottom perimeter at said lower ends, a locker back rim protruding from the locker back side at its upper end and including a vertical face, a removable locker lid on the upper ends of the locker sides, said lid including a top and an overhanging, downward-depending skirt extending over the locker back rim, a hinge attached rearward of the box-like container between the locker back rim vertical face and the lid skirt at the locker back side such that the skirt covers and thus protects the hinge.

2. The marine storage locker of claim 1 in which the skirt depends downward from the lid less than the rim extends from the locker back side, and the lid rotates on the hinge at least 90 degrees as the lid skirt at the back side extends under the locker back rim.

3. The marine storage locker of claim 2 in which the lid skirt at the back side contacts the rim on a rim underside in a lid open position limiting further lid rotation.

4. The marine storage locker of claim 3 in which the lid open position is more than 90 degrees from its closed position with the said skirt leaning against said rim so that gravity biases the lid in a stable open position.

5. A marine storage locker for use on a boat having a step platform astern of a boat transom, the improvement in said marine storage locker comprising a box-like container including first and second opposing locker sides separated by a front side and a back side opposite the front side, the sides terminating at upper and lower ends and joined about a bottom perimeter at said lower ends, a locker back rim protruding from the locker back side at its upper end and including a vertical face, a removable locker lid on the upper ends of the locker sides, said lid including a top and an overhanging, downward-depending skirt extending over the locker back rim, a hinge attached between the locker back rim and the lid skirt at the locker back side such that the skirt covers and thus protects the hinge, a lid recess in the lid top near the front side, a lid latch mounted fully within the lid recess below the lid top to maintain a generally flat, unobstructed lid top, a latch box within the locker on the locker front side under the lid latch, a locker latch operating in cooperation with the lid latch to secure the lid in closed position.

6. The marine storage locker of claim 5 in which the latch box has a water channel hole adapted to drain water external to the latch box and locker.

7. A boat having a transom terminating in a transom top and a step platform astern of the transom comprising a vertical portion of the boat transom, a horizontal bottom normal to the transom, the improvement comprising in combination therewith a removable marine storage locker sized to be received in closely-fit relation on the step platform, including a locker bottom on the step platform, first and second opposing locker sides separated by a front side for disposition face to face with the boat transom and a back side opposite the front side, the sides terminating at upper and lower ends and joined about a bottom perimeter at said lower ends, the locker sides of a height such that a lid top is at a level commensurate with that of the transom top said locker lid removable on the upper ends of the locker sides, said lid having a top and including an overhanging, downward depending skirt at the locker back side, a locker back rim protruding from the locker back side at its upper end over which the lid back side skirt extends, a hinge attached between the locker back rim and the lid skirt at the locker back side such that the skirt covers and thus protects the hinge.

8. The marine storage locker of claim 7 further comprising locker sides of a height such that the lid top is at a level commensurate with that of the transom top when the locker is installed on the boat step platform.

9. The marine storage locker of claim 8 in which the lid top at a level commensurate with that of the transom top provides therein an extension of the transom top as an enlarged counter surface.

* * * * *